United States Patent [19]

Zilver

[11] 3,968,826

[45] July 13, 1976

[54] MOUNTING BRACKET FOR A BLIND

[75] Inventor: Edwin Zilver, Beethovenlaan, Netherlands

[73] Assignee: Silverflex International N.W., London, England

[22] Filed: Apr. 15, 1974

[21] Appl. No.: 460,978

[30] Foreign Application Priority Data

Apr. 19, 1973 Netherlands ..... 7305524

[52] U.S. Cl. ..... 160/323 R

[51] Int. Cl.[2] ..... E06B 9/08

[58] Field of Search ..... 16/128 R, 137; 160/323 R, 324, 325, 326, 238, 307, 323 B; 248/324

[56] References Cited

UNITED STATES PATENTS

| | | | |
|---|---|---|---|
| 332,299 | 12/1885 | Stewart | 160/326 X |
| 2,233,351 | 2/1941 | Rowe | 16/137 |
| 2,592,230 | 4/1952 | Allen | 16/137 |
| 3,379,403 | 4/1968 | Meehan | 248/278 X |

FOREIGN PATENTS OR APPLICATIONS

| | | | |
|---|---|---|---|
| 1,561,217 | 2/1969 | France | 160/238 |
| 27,242 | 12/1904 | United Kingdom | 160/324 |

*Primary Examiner*—George H. Krizmanich
*Attorney, Agent, or Firm*—Norris & Bateman

[57] ABSTRACT

A mounting bracket for supporting either end of a roller or other blind is formed in two pivotally connected parts one of which is adapted to be secured to a part of the blind mechanism and the other of which is angularly movable through 180° relative to the first part and can be secured to either a horizontal or vertical surface as desired.

7 Claims, 4 Drawing Figures

MOUNTING BRACKET FOR A BLIND

The invention relates to a mounting bracket for a roller blind, venetian blind or the like, provided with a first portion which is capable of being secured to a wall, window frame, ceiling or the like, and a second portion for supporting a cord-guide, brake or the like.

Many constructions of such mounting brackets are known. One difficulty with such brackets is that those for securing to a vertical surface such as the side of a window frame or a wall are, generally speaking, different from those for securing to a horizontal surface, such as a ceiling. Moreover, the difficulty with many constructions is that so-called right hand and left hand constructions are necessary for brackets which have to be mounted at one or the other end of a roller blind, venetian blind or the like.

The present invention aims at providing a simple, cheap construction, with which said difficulty is removed. Accordingly, the invention is characterised in that the first and second portions are rotatably connected to each other, in such a way that relative rotation is possible through at least 180°.

It has been found that when mounting such a bracket it should be possible to maintain the angle between said portions at a desired value without the necessity for using tools to rotate the portions with respect to each other.

Accordingly, it is provided according to a further feature of the invention, that the connection between the two portions is such that although relative rotation is prevented in use adjustment can easily be carried out by hand.

A simple robust embodiment of the invention is obtained by providing the rotatable connection between the portions with a central circular aperture to receive a trunnion at the end of a blind roller.

Technically this can be carried out in a cheap and simple but reliable manner by making the two portions of the bracket contact each other at the location of the rotatable connection and providing registering circular apertures in said portions through which a bush is passed.

In order to ensure that the two portions which are rotatably mounted with respect to each other, remain in the desired angular position to which they have been adjusted, it is preferred, when applying the invention, to provide a locking member which can fix said portions with respect to each other in predetermined mutual angular positions.

An advantageous embodiment of the invention is obtained when the locking member is mounted concentrically of the axis of the pivot connection between said two portions and said portions are provided with apertures which can cooperate with projections on the locking member.

In this manner, a combination of functions can be obtained by making the locking member a cage for a cord reel. Such a cage is described in co-pending application Ser. No. 406,468 filed Oct. 15, 1973 now abandoned but the subject matter thereof incorporated into copending continuation-in-part application Ser. No. 542,556 filed Jan. 20, 1975.

Finally, the invention also provides the possibility of mounting a cord-brake on the second portion.

The invention is illustrated in the accompanying drawing, in which:

FIG. 1 is a view of a mounting bracket according to the invention with a blind roller carried thereby;

FIG. 1*a* shows a section on an enlarged scale of a part of the construction shown in FIG. 1;

Figure 1:
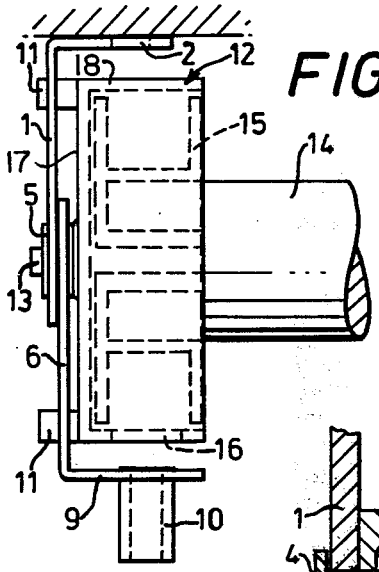

The bracket shown in the drawing comprises a first portion 1 in the form of an angle plate having a pair of holes 2 through which the portion may be secured to a fixed structural member, e.g. a wall, window frame or ceiling. In portion 1, furthermore, a circular hole 3 is provided and also, a hole 4 through which a bearing bush, which is flared at both ends is passed. A second portion of the bracket in indicated by 6 and has a hole 7, through which the bush 5 is also passed. The flaring at both ends of the bush is such that the portions 1 and 6 are in frictional contact but can be rotated by hand with respect to each other about the axis of the holes 4 and 7. Portion 6 also has a hole 8 and a cord-guide 10 on a flanged portion 9 thereof, said cord-guide preferably being formed as a cord-brake, such as that disclosed in copending Ser. No. 464,303 filed Apr. 26, 1974. Holes 3 and 8 are adapted to receive projections 11 on a cord-reel cage 12 which mainly consists of a flat circular disc 17 and a cylindrical flange 18 extending therefrom over the reel periphery. Said cylindrical flange 18 is formed with an aperture 16 for the passage of a cord to the cord-brake or cord-guide 10.

As originally disclosed in said Ser. No. 406,468 reel 15 is secured to roller 14, and the blind roller 14 has an axially projecting trunnion extending into bush 5 for rotatable support. The cage 12 is loosely mounted on trunnion 13 and, as will appear, it may be rotated to suit the selected bracket portion positions and there retained against excessive rotation about the axis of trunnion 13 by projections 11 loosely fitting into bracket openings 3 and 8 as shown. In turn, as can be seen in FIGS. 2 and 3, the cage thus prevents the bracket portions from departing from their selected positions.

Figure 2:
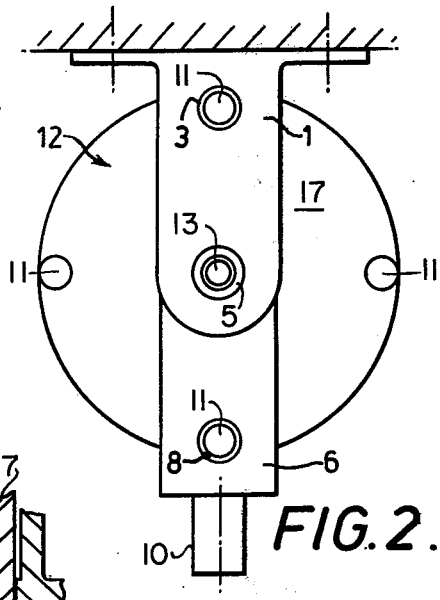
FIG. 2 is a view looking from the left in FIG. 1.
Figure 1A:
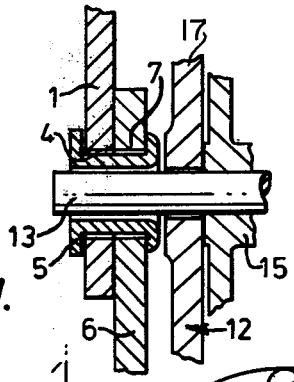
Figure 3:
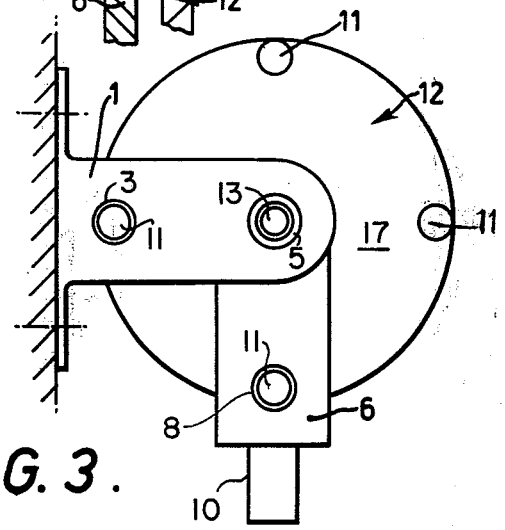
FIG. 3 is a view corresponding to FIG. 2 showing a further position of use of the bracket.

As appears from FIGS. 2 and 3 the construction can be adjusted in a very simple manner for securing either to a horizontal surface (FIG. 2) or a vertical surface (FIG. 3). In this connection, it is pointed out with reference to FIG. 3, that when portion 1 is rotated through 180° about the axis of a trunnion 13 the same bracket can be mounted at the other end of the roller 14. The embodiment shown consequently has the advantage that it can be used in three different positions and the construction is extremely simple and cheap to manufacture, particularly because the bush 5 plays the double role of interconnecting the portions 1 and 6 and providing a bearing for the trunnion 13. Moreover the cage 12 has the double function of retaining the cord on a reel 15 secured to the roller 14 and securing portions 1 and 6 in any of their positions of adjustment.

The cord-brake has not been illustrated in detail because this does not form a part of the present invention. It is also possible to omit the brake and to provide only a cord-guide on the flanged portion 9 of the rotatable portion 6 of the bracket.

I claim:

1. In a blind assembly, a blind member, mounting bracket means having separate members, means pivotally interconnecting said bracket members at adjacent ends, one of said bracket members having means at the other end for attachment to a wall, ceiling or like anchorage, means rotatably mounting said blind member on said bracket means substantially coaxially of the pivot axis between said bracket members, a cord reel secured on said blind member adjacent said bracket means, a tubular cage member loosely mounted on said blind member between said reel and said bracket means and having an annular flange extending over the periphery of said reel, and cooperating interengaging means on said cage member and both of said bracket members whereby said cage member may retain said bracket members in any one of a plurality of selected relative angular positions while said bracket means positively limits displacement of said cage member relative to said reel.

2. In the blind assembly defined in claim 1, said means pivotally connecting said bracket members being a hollow member wherein the adjacent end of said blind member is rotatably supported.

3. In the blind assembly defined in claim 2, said hollow member being a unitary bushing axially as well as rotatably interconnecting said bracket members.

4. In the blind assembly defined in claim 3, said bracket members having coextensive flat surfaces at said pivotal connection and said bushing fitting with said bracket members so as to hold said bracket surfaces in frictional contact.

5. In the blind assembly defined in claim 2, said blind member having an end trunnion rotatably mounted in said hollow member and said cage member being loosely mounted on said trunnion.

6. In the blind assembly defined in claim 1, said interengaging means on said bracket and cage members comprising angularly spaced axial projections and cooperating openings for receiving said projections.

7. In a blind assembly, a blind roller, mounting bracket means comprising two separate overlapping members one of which is apertured for the passage of means for securing the member to a wall, ceiling or like anchorage and the other of which carries a cord guide, a unitary hollow bushing pivotally interconnecting overlapping portions of said bracket members and maintaining said overlapping portions in frictional contact with each other, and means rotatably mounting one end of said blind roller in said bushing.

* * * * *